US006412238B2

(12) United States Patent
Rillie et al.

(10) Patent No.: US 6,412,238 B2
(45) Date of Patent: Jul. 2, 2002

(54) SYSTEMS AND METHODS FOR CONNECTING SKYLIGHT COMPONENTS

(75) Inventors: David W. Rillie, Del Mar; Joseph W. Prenn, San Diego; Philip Edward Warren, Solana Beach; Christian P. Stevens, Carlsbad; Bing-Ling Chao, San Diego, all of CA (US)

(73) Assignee: Solatube International, Inc., Vista, CA (US)

( * ) Notice: Subject to any disclaimer, the term of this patent is extended or adjusted under 35 U.S.C. 154(b) by 0 days.

(21) Appl. No.: 09/932,775

(22) Filed: Aug. 17, 2001

Related U.S. Application Data

(62) Division of application No. 09/414,175, filed on Oct. 7, 1999, now Pat. No. 6,321,493.

(51) Int. Cl.[7] ..... E04B 7/18
(52) U.S. Cl. ..... 52/200
(58) Field of Search ..... 24/16 R, 279; 248/74.3; 52/200

(56) References Cited

U.S. PATENT DOCUMENTS 3,667,710 A * 6/1972 Moody et al.
4,073,097 A * 2/1978 Jentoft et al.
4,080,763 A * 3/1978 Naidus et al.
4,468,899 A * 9/1984 Miller
RE32,539 E * 11/1987 Jentoft et al.
5,112,013 A * 5/1992 Tolbert et al.
5,172,879 A * 12/1992 Calmettes et al.
5,983,581 A * 11/1999 DeBlock et al.
RE36,496 E * 1/2000 Sutton

* cited by examiner

*Primary Examiner*—Milton Nelson, Jr.
(74) *Attorney, Agent, or Firm*—John L. Rogitz

(57) ABSTRACT

Various skylight connectors are disclosed. A sheet is integrally formed with tabs along opposed axial edges of the sheet, and the sheet can be bent into a tubular configuration with the tabs along one edge engaging tab holes along the other edge and vice-versa to hold the sheet in the tubular configuration. Also, a skylight dome fastener adaptor includes a hollow body, and ribs are formed on the outer surface to engage a hole in a skylight dome to impede rotation of the body in the hole when a fastener is disposed in the adaptor and threadably engaged with a dome flashing. Additionally, various quick connect zip ties and clips are disclosed for quickly and easily engaging components of a skylight assembly.

1 Claim, 2 Drawing Sheets

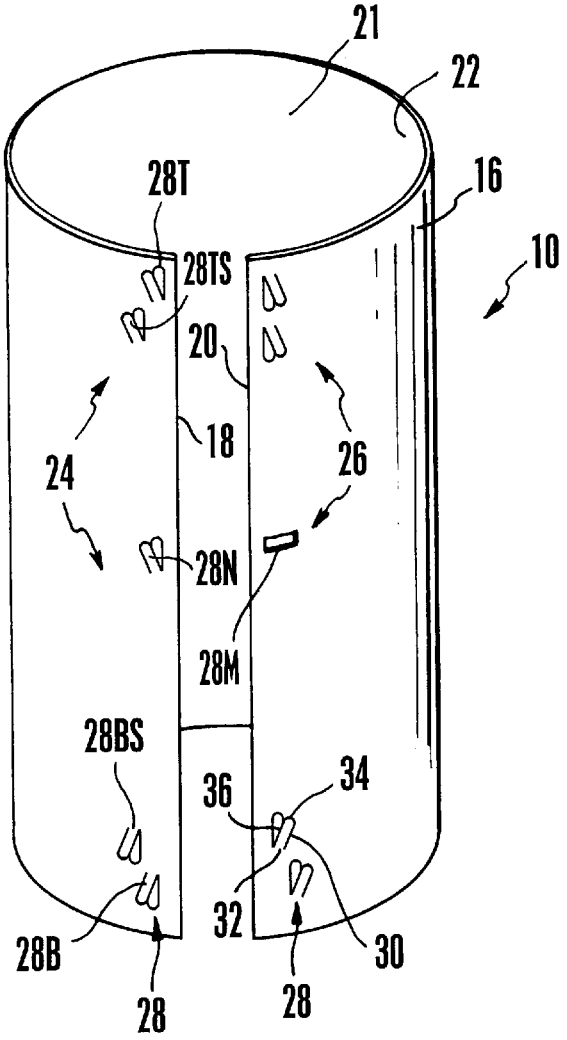
Fig. 1
Fig. 2
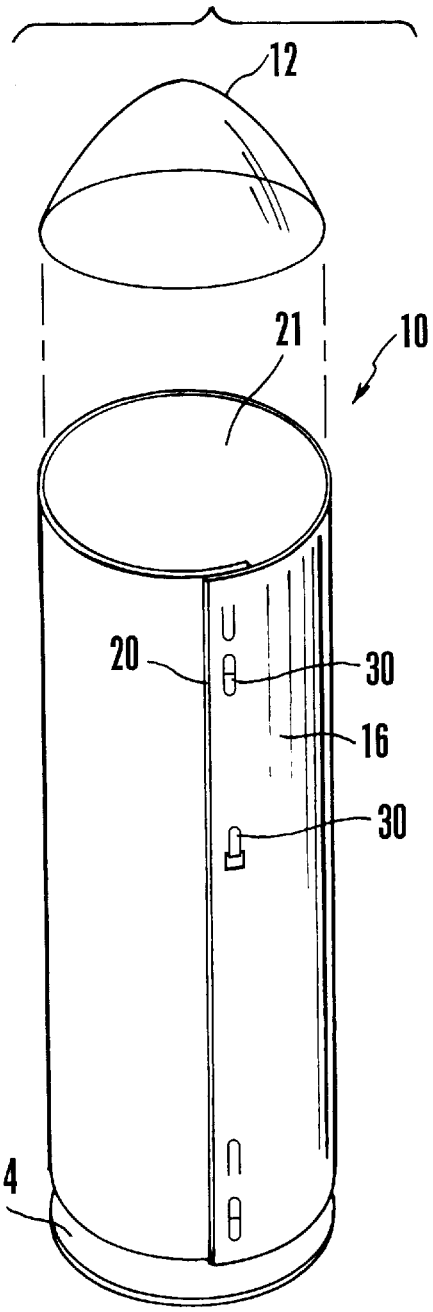
Fig. 3
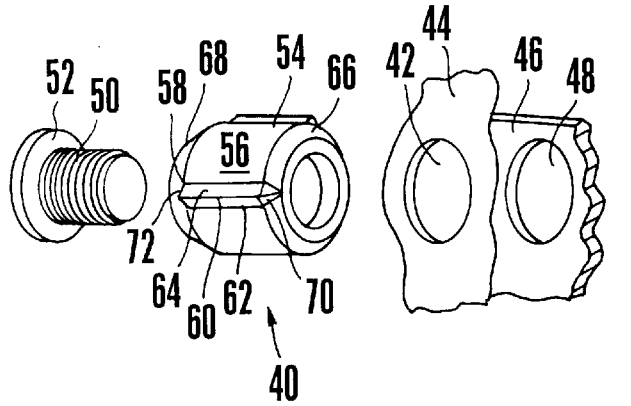

SYSTEMS AND METHODS FOR CONNECTING SKYLIGHT COMPONENTS

This application is division of application Ser. No. 09/414,175, filed Oct. 7, 1999, now U.S. Pat. No. 6,321,493 filed Nov. 27, 2001.

FIELD OF THE INVENTION

The present invention relates generally to connectors for tubular skylights.

BACKGROUND

Tubular skylights have been provided for illuminating the interiors of buildings in an aesthetically pleasing and energy efficient way with natural sunlight. An example of a commercially successful skylight is disclosed in the present assignee's U.S. Pat. Nos. 5,099,622, and further examples of effective tubular skylights are disclosed in the present assignee's U.S. Pat. No. 5,896,713 and in allowed U.S. patent application Ser. No. 09/126,331, all of which are incorporated herein by reference.

In tubular skylights such as the those mentioned above, a transparent plastic dome is mounted on a roof of a building by means of a metal flashing that is attached to the roof. Extending down from the dome is a metal tube that has a highly reflective inner surface. The tube extends down to the ceiling of the interior room sought to be illuminated, where it terminates at a disk-shaped light diffuser mounted on the ceiling by means of one or more support rings that engage the lower end of the tube.

It will be appreciated that with the above general description of tubular skylights in mind, many components must be connected together. As but one example, the tube itself is ordinarily made from a flat sheet of metal that is bent into a cylindrical shape to form the tube, with the opposite ends of the sheet of metal slightly overlapping each other in the cylindrical configuration and being held in the cylindrical configuration by manually taping the length of the joint between the ends of the bent sheet. As understood by the present invention, while effective, the above-mentioned manual means for forming the tube can result in tubes having diameters that might exhibit deviations slightly from design. Moreover, it is sometimes desirable that the tube slightly taper, i.e., assume a slightly frusto-conical shape, and it is difficult to precisely configure a tube to have such a shape using the manual taping method described above. Fortunately, the present invention recognizes that it is possible to easily and with a high degree of repeatability effect a precisely-configured skylight tube.

As another example, consider the connection between the plastic dome and metal flashing. A metal screw is advanced through an ABS washer that is positioned in a hole in the dome, and the screw engages the metal flashing. As recognized herein, the washer can sometimes undesirably rotate in the hole of the dome, thereby rendering it less than optimally effective as a connection interface with the screw and, hence, the flashing to which the dome is mounted.

As yet other examples, connecting the diffuser and the various support rings to the lower end of the tube and to the ceiling must be accomplished in relatively confined areas, and accordingly can be a cumbersome and time-consuming task. The present invention understands that such connections can be effected quickly and securely by the novel connecting systems and methods disclosed herein.

SUMMARY OF THE INVENTION

A light transmitting member for a skylight includes a sheet defining opposed axial edges. The sheet can be bent into a light transmitting configuration, wherein the axial edges are juxtaposed with each other and a light transmitting channel is established by the sheet. First and second sets of axially spaced tab elements are formed along respective axial edges of the sheet. A first tab element in the first set includes a tab while a second tab element in the second set defines a tab opening. As disclosed in detail below, the tab is movable between an engage configuration, wherein the tab can be received through the tab opening, and a lock configuration, wherein the tab cannot be removed from the tab opening to thereby hold the sheet in the light transmitting configuration. Indeed, at least upper and lower tab elements include respective tabs and respective tab openings, and the tab of each tab element in a pair is receivable through the tab opening of the other tab element in the pair.

In a preferred embodiment, each set of tab elements includes at least two tab elements. The tab elements in the first set are juxtaposed with respective tab elements in the second set when the member is in the light transmitting configuration to establish plural tab element pairs. Each tab element is integral to the sheet, i.e., the sheet is cut to form the tabs, with the tabs being retained on the sheet by an uncut living hinge.

Furthermore, the sheet is formed with at least two upper tab elements in each set of tab elements. The upper tab elements of one set are axially and radially spaced from each other to facilitate selectively establishing one of: a frusto-conical shape, and a cylindrical shape, of the sheet in the light transmitting configuration.

In another aspect, a method for forming a skylight tube includes providing a sheet defining first and second opposed edges, and forming plural tabs along at least the first edge and forming plural tab openings along at least the second edge. The method further includes advancing the tabs through respective tab openings with the sheet in a light transmitting configuration. Then, the tabs are bent to hold the sheet in the light transmitting configuration.

In yet another aspect, a skylight tube includes a sheet having a reflective surface. Fasteners are formed integrally on the sheet. The fasteners can be moved to hold the sheet in a light transmitting configuration, wherein the reflective surface is an inside surface.

In another aspect, a skylight dome fastener adaptor includes a hollow body defining an outer surface. Plural ribs are formed on the outer surface and are configured for engaging a hole in a skylight dome in an interference fit to impede rotation of the body in the hole.

In still another aspect, a lower skylight assembly includes a skylight dress ring that has a vertical flange formed with at least one clip hole. A skylight support ring has a vertical flange closely spaced from the vertical flange of the dress ring and terminating in a horizontal flange defining a ratchet aperture. Per present principles, a zip clip has an elongated body defining opposed first and second elongated surfaces, and a clip protrudes from one of the surfaces and is received in the clip hole of the dress ring. Also, at least one of the surfaces of the zip clip is formed with ratchet structure that engages the ratchet aperture of the support ring to thereby hold the dress ring onto the support ring.

In yet another embodiment, a zip tie has an elongated body defining first and second ends. A ratchet structure is formed on the body. Moreover, a clip arm is attached to and extends perpendicularly away from the first end of the body. Still further, the clip arm defines a channel. The channel is configured to receive a threaded fastener in self-tapping threadable engagement.

The details of the present invention, both as to its structure and operation, can best be understood in reference to the accompanying drawings, in which like reference numerals refer to like parts, and in which:

BRIEF DESCRIPTION OF THE DRAWINGS

FIG. 1 is a perspective view of a skylight tube sheet prior to fastening the sheet in the light transmitting configuration;

FIG. 2 is a perspective view of a skylight tube sheet in the light transmitting configuration, in an exploded relationship with a skylight dome and a diffuser plate;

FIG. 3 is a perspective view of the skylight dome fastener adaptor, in exploded relationship with a skylight dome, fastener, and flashing, with portions of the dome and flashing cut away for clarity;

DETAILED DESCRIPTION OF THE PREFERRED EMBODIMENT

Figure 4:
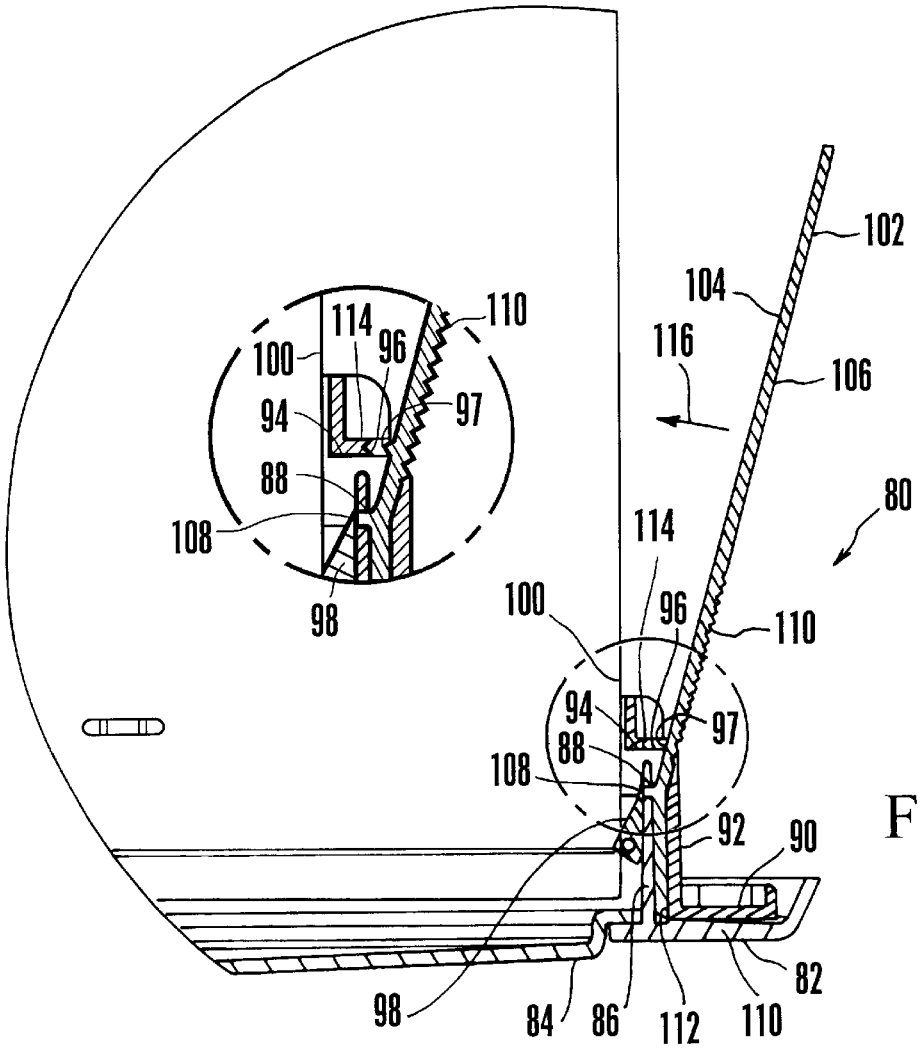
FIG. 4 is a partial cross-sectional view of the lower end of a skylight, showing a zip clip engaging the dress ring with the support ring, with the zip clip illustrated as being displaced into the support ring to better illustrate the ratchet opening.

Referring initially to FIGS. 1 and 2, a light transmitting member is shown, generally designated 10, for transmitting light from a roof-mounted plastic transparent dome 12 to a ceiling-mounted diffuser plate 14. As disclosed in detail below, the member 10 can be formed in a cylindrical configuration or in a slightly tapered, i.e., frusto-conical, configuration to establish a skylight tube.

As shown in FIG. 1, the member 10 includes a metal sheet 16 that defines opposed axial edges 18, 20. When the sheet 16 is bent in the light transmitting configuration shown in FIG. 2, the axial edges 18, 20 are closely juxtaposed with each other and indeed overlap each other. In the light transmitting configuration, the sheet 16 defines a light transmitting channel 21 that is bounded by an inside surface on which is disposed a reflective coating 22, to render the inside surface highly reflective.

In accordance with the present invention, to provide a means for holding the sheet 16 in the light transmitting configuration shown in FIG. 2, fasteners are formed on the sheet 16. More specifically, first and second sets 24, 26 of tab elements, generally designated 28, are formed integrally in the sheet 16 along respective axial edges 18, 20, as best shown in FIG. 1. The tab elements 28 in a set accordingly are axially spaced from each other. More specifically, each set 24, 26 of tab elements includes two upper elements 28 as shown, two lower elements 28, and a single middle element 28, although other element patterns can be established in accordance with present principles. In any case, as can be appreciated in reference to FIGS. 1 and 2, the tab elements 28 in the first set 24 are juxtaposed with respective tab elements 28 in the second set 26 when the sheet 16 is in the light transmitting configuration, to establish plural tab element pairs for purposes to be shortly disclosed.

In the second set 26 of tab elements, the elements 28 are colinear with each other as shown in FIG. 1. Also, in the second set 26, the two upper and two lower tab elements 28 each include a respective tab 30 formed by a cut in the sheet 16 around three sides of the tab 30, with a fourth side of the tab 30 being uncut and consequently establishing a living hinge 32 about which the tab 30 can be pivoted. The free end 34 of each tab 30, i.e., the end opposite the respective living hinge 32, can be rounded as shown for safety. When the tab 30 is pivoted away from the sheet 16, a tab opening 36 is established as shown best in FIG. 1. If desired, the tab of the middle tab element 28M in the second set 26 can be removed, such that the middle element 28M consists of a permanent aperture as shown in FIG. 1.

The tab elements 28 in the first set 24 are essentially identical in construction and operation to the tab elements 28 in the second set 26 shown in FIG. 1 and described above, with the following exceptions. The top-most element 28T, middle element 28N, and bottom-most element 28B are axially aligned with each other as shown. On the other hand, a second top element 28TS that is closely spaced from the top-most element 28T and second bottom element 28BS that is closely spaced from the bottom-most element 28B are axially aligned with other and are slightly axially and radially spaced from the top-most and bottom-most elements 28T, 28B, respectively. The middle element 28N of the first set 24 of elements includes both a tab and a tab opening as shown.

With the above disclosure in mind, it may now be appreciated that the tab 30 of the top-most element 28T in the first set 24 can be moved about its respective living hinge 32 to an engage configuration, wherein the tab 30 extends radially outwardly from the sheet 16 and the tab 30 can be received through the tab opening 36 of the corresponding tab element 28 in the opposite set 26. Also, the tab 30 can be moved to a lock configuration, wherein the tab 30 is folded back away from the opening 36 in which it is received to overlap the sheet 16, such that the tab 30 cannot be easily removed from the tab opening 36 (without bending the tab) to thereby hold the sheet 16 in the light transmitting configuration. Likewise, the tab 30 of the middle element 28N in the first set 24 can be engaged with the middle element 28M of the second set 26, and the bottom-most element 28B of the first set 24 can engage the corresponding element in the second set 26 of tab elements. It is to be understood that the tabs 30 in the second set 26 can be likewise interlocked with tab openings 36 in the first set 24 of tab elements. In the example above, the second top element 28TS and second bottom element 28BS are not used, and a skylight tube is provided that has a cylindrical configuration and a maximum diameter.

It is to be further appreciated that instead of using the top-most and bottom-most elements 28T, 28B, the second top element 28TS and second bottom element 28BS can be used in conjunction with the middle element 28N of the first set 24, thus providing a skylight tube with a cylindrical configuration and a minimum diameter. Still further, a skylight tube can be provided that has a slightly frusto-conical shape by using the top-most element 28T, middle element 28N, and second bottom element 28BS of the first set 24. Or, a skylight tube can be provided that has a slightly frusto-conical shape by using the second top element 28TS, middle element 28N, and bottom-most element 28B of the first set 24.

FIG. 3 shows a skylight dome fastener adaptor 40 that can be disposed in a hole 42 of a plastic transparent skylight dome 44. The top lip portion of a metal flashing 46 can be juxtaposed with the dome 44. The flashing 46 is formed with a hole 48 that is juxtaposed with the hole 42 of the dome 44 and that indeed is coaxial therewith. With this structure, the threaded shank 50 of a fastener 52 is advanced through the adaptor 40 and can be threadably engaged with the hole 48 of the flashing 46 (or with a nut opposite the hole 48) to hold the dome 44 against the flashing 46.

As shown in FIG. 3, the adaptor 40 includes a hollow hard plastic rigid body 54 that defines an outer surface 56, and plural, preferably three, ribs 58 are formed on the outer surface 56. The ribs 58 engage the hole 42 in the skylight dome 44 in an interference fit to impede rotation of the body 54 in the hole 42 when torque is applied to the fastener 52.

In the preferred embodiment shown, each rib 58 includes an axially aligned outer edge 60 and opposed ramped sides 62, 64 that extend from the edge 60 to the outer surface 56 of the body 54. Thus, the ribs 58 have triangular cross-sections. As intended by the present invention, the ribs 58 are formed integrally with the body 54.

In one preferred embodiment, the body 54 is formed with opposed chamfered ends 66, 68 as shown. If desired, each rib 54 can include respective rib extensions 70, 72 that are formed on respective ends 66, 68 of the body 54.

Now referring to FIG. 4, a lower portion of a skylight assembly is shown, generally designated 80. The assembly 80 includes a ring-shaped plastic skylight dress ring 82 that supports a disk-shaped diffuser plate 84. In the preferred embodiment shown, the dress ring 82 is formed with a ring-shaped vertical flange 86 that in turn is formed with one or more clip holes 88. Moreover, a metal or plastic ring-shaped skylight support ring 90 has a vertical flange 92 that is closely spaced from and parallel to the vertical flange 86 of the dress ring 82. As shown in FIG. 4, the vertical flange 92 of the support ring 90 terminates at its upper edge in a ring-shaped horizontal flange 94 that defines at least one ratchet aperture 96 therethrough. A ratchet tooth 97 extends into the ratchet aperture 96. If desired, a resilient ring-shaped rubber or plastic seal 98 can be disposed between the vertical flange 86 of the dress ring 82 and a lower metal skylight tube segment 100.

In accordance with present principles, a flexible plastic zip clip 102 holds the dress ring 82 and support ring 90 together. To facilitate this, the zip clip 102 has an elongated body as shown that defines opposed inner and outer elongated surfaces 104, 106. A small parallelepiped-shaped clip 108 protrudes from the inner surface 104, and the clip 108 is closely received in the clip hole 88 of the dress ring 82. Furthermore, the outer surface 106 of the zip clip 102 is formed with zip tie-like ratchet structure 110 that is configured to engage the ratchet tooth 97 of the support ring 90 and thereby hold the dress ring 82 onto the support ring 90. Both the clip 108 and ratchet structure 110 are made integrally with the body of the zip clip 102.

In a particularly preferred embodiment, the dress ring 82 is formed with a ramp 110 that terminates in an abutment 112. As shown in FIG. 4, the lower end of the zip clip 102 is sandwiched between the abutment 112 and the vertical flange 86 of the dress ring 82, to support the zip clip 102. If desired, a small piece of felt 114 can be glued into the ratchet aperture 96, with the zip clip 102 being biased against the felt 114 as indicated by the arrow 116 in FIG. 4.

Figure 5:
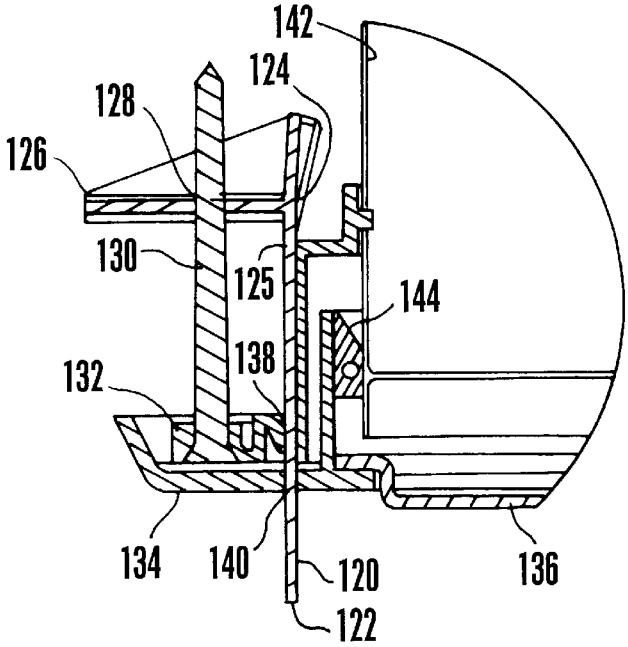
FIG. 5 is a cross-sectional view of the present zip tie with dry wall screw receiving channel, in operable engagement with a ceiling ring and dress ring.

FIG. 5 shows a flexible plastic zip tie 120 that includes an elongated body defining first and second ends 122, 124. A zip tie-like ratchet structure 125 is integrally formed on the zip tie 120 as shown. Furthermore, a rigid clip arm 126 is formed integrally with and extends perpendicularly away from the end 124 of the tie. In accordance with present principles, the clip arm 126 defines a channel 128 generally parallel to the body of the zip tie 120 and thus perpendicular to the clip arm 126. It is to be appreciated in reference to FIG. 5 that the channel 128 receives a threaded fastener 130, such as a dry wall screw, with the fastener 130 self-tapping in the channel 128 as it is engaged therewith.

With this structure, the zip tie 120 can be used to interconnect skylight assembly components such as a ceiling ring 132 and dress ring 134 holding a diffuser plate 136 with a portion of dry wall. More specifically, the zip tie 120 ratchetably engages the ceiling ring 132 and dress ring 134 in respective ratchet slots 138, 140, and then a structure such as a beam or ceiling or wall can be clamped between the arm 126 and ceiling ring 132. Moreover, the fastener 130 can be manipulated to engage further wall or ceiling structure above the zip tie 120. Completing the description of FIG. 5, the ceiling ring 132 engages a lower portion 142 of a skylight tube, and a resilient seal ring 144 can be sandwiched between the dress ring 134 and lower portion 142.

While the particular SYSTEMS AND METHODS FOR CONNECTING SKYLIGHT COMPONENTS as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. §112, sixth paragraph, unless the element is expressly recited using the phrase "means for".

What is claimed is:

1. A zip clip for holding a skylight dress ring onto a skylight support ring, comprising:

an elongated body defining an elongated outer surface and an opposed elongated inner surface;

a ratchet structure formed on at least a segment of the outer surface;

a clip formed on the inner surface and protruding away therefrom;

a skylight dress ring having a flange formed with at least one clip hole and an abutment opposite the flange; and skylight support ring having a flange closely spaced from the flange of the dress ring and terminating in a flange defining a ratchet aperture, wherein the clip of the zip clip is received in the clip hole of the dress ring and the zip clip is sandwiched between the flange of the dress ring and the abutment, the ratchet structure of the zip clip engaging the ratchet aperture of the support ring to hold the dress ring onto the support ring.

* * * * *